US011638453B2

(12) United States Patent
Eckensweiler

(10) Patent No.: US 11,638,453 B2
(45) Date of Patent: May 2, 2023

(54) SLEEVE WITH INTEGRATED INSERT

(71) Applicant: NIKE, Inc., Beaverton, OR (US)

(72) Inventor: Mitchell L. Eckensweiler, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 299 days.

(21) Appl. No.: 16/579,100

(22) Filed: Sep. 23, 2019

(65) Prior Publication Data

US 2020/0138137 A1 May 7, 2020

Related U.S. Application Data

(60) Provisional application No. 62/755,920, filed on Nov. 5, 2018.

(51) Int. Cl.
*A41F 19/00* (2006.01)
*A41B 1/08* (2006.01)

(52) U.S. Cl.
CPC ..... *A41F 19/005* (2013.01); *A41B 1/08* (2013.01)

(58) Field of Classification Search
CPC ..... A41B 1/08; A41B 1/10; A41F 19/005
See application file for complete search history.

(56) References Cited

U.S. PATENT DOCUMENTS 701,252 A * 5/1902 Bandler ..... A41F 9/02 2/237
811,662 A * 2/1906 Puryear ..... A41D 1/06 2/269
1,709,508 A * 4/1929 Weiner ..... A41F 9/025 2/237
2,274,510 A * 2/1942 Wohl ..... A41D 19/0041 2/270
2,836,828 A * 6/1958 Henrikson ..... A41D 19/01 2/158

(Continued)

FOREIGN PATENT DOCUMENTS

CA 2289895 A1 5/2000
CN 1541578 A 11/2004

(Continued)

OTHER PUBLICATIONS

Men's Midgard Zip-Up https://www.lokiusa.com/ collections/mens/ products/c215?variant=39619507021.

(Continued)

*Primary Examiner* — Richale L Quinn
(74) *Attorney, Agent, or Firm* — Shook, Hardy & Bacon, LLP

(57) ABSTRACT

Aspects herein are directed to a sleeve having a first length in a retracted state and a second length in an extended state. The sleeve may have a third opening positioned between first and second openings of a cylindrical tube. A releasable fastener may be affixed proximate the third opening and hold the sleeve in the retracted state when fastened and may allow the sleeve to move to the extended state when unfastened. An insert may be affixed around a perimeter of the third opening. The insert may include a thumb receiving portion. The thumb receiving portion may have a thumb opening. The insert may be retained interior to the cylindrical tube when the sleeve is in the retracted state.

18 Claims, 8 Drawing Sheets

(56) References Cited

U.S. PATENT DOCUMENTS 3,110,903 A * 11/1963 Burchard ..... A41D 1/08 2/221
3,214,771 A * 11/1965 Treiber ..... A41D 19/0041 2/270
3,771,169 A * 11/1973 Edmund ..... B63C 11/04 2/2.17
4,195,405 A 4/1980 Monk
4,297,746 A * 11/1981 Zarbos ..... A41D 3/00 2/108
4,359,784 A * 11/1982 Harrington ..... A41D 27/10 2/158
4,756,027 A * 7/1988 Buenos ..... A41D 19/0041 2/123
4,773,100 A * 9/1988 Kuo ..... A41D 3/06 2/159
4,918,756 A * 4/1990 Grilliot ..... A41D 19/01529 2/159
4,924,529 A * 5/1990 Grilliot ..... A41D 27/10 2/123
5,090,058 A * 2/1992 Gerber ..... A41D 27/10 2/97
5,504,944 A * 4/1996 Bromer ..... A41D 19/01 2/125
5,542,125 A * 8/1996 Zuckerwar ..... A41D 19/0051 2/158
5,575,010 A * 11/1996 Chung ..... A41D 1/06 2/227
5,678,248 A 10/1997 Lengyel
5,784,720 A * 7/1998 Mellon ..... A41D 19/0041 2/123
5,794,265 A * 8/1998 Reich ..... A41D 27/10 2/125
5,815,837 A * 10/1998 Christman ..... A41D 19/0041 2/158
6,076,189 A 6/2000 Christman et al.
6,279,161 B1 * 8/2001 Johnston ..... A41D 13/0015 2/69
6,449,772 B1 * 9/2002 Donner ..... A41D 13/088 2/16
6,839,911 B1 * 1/2005 Mathews ..... A41D 15/00 2/69
6,996,847 B2 * 2/2006 Anderson ..... A41D 3/02 2/158
7,290,291 B2 11/2007 Anderson et al.
7,296,302 B2 * 11/2007 DeLorenzo ..... A41D 3/005 2/202
7,310,825 B2 * 12/2007 St-Germain ..... A41D 27/10 2/123
7,516,499 B2 * 4/2009 Gardner, III ..... A41D 1/21 2/221
8,028,351 B2 * 10/2011 Stachler ..... A41D 13/0005 2/457
8,856,965 B1 * 10/2014 Theofield ..... A41D 19/0041 2/125
8,904,564 B2 * 12/2014 Laycock ..... A41D 19/0041 2/94
8,904,566 B2 12/2014 Clark
9,364,036 B2 * 6/2016 Clark ..... A41D 19/01
D765,351 S 9/2016 Shaw
9,554,601 B2 1/2017 Arajakis
10,117,473 B2 * 11/2018 Sullivan ..... A41D 19/0013
10,194,708 B2 * 2/2019 Rhodes ..... A41D 27/10
10,973,265 B2 * 4/2021 Inzer ..... A41B 9/001
D918,537 S * 5/2021 Eckensweiler ..... D2/858
11,064,747 B2 * 7/2021 Zahradka ..... A41D 19/0041
2003/0154536 A1 * 8/2003 Anderson ..... A41D 3/02 2/108
2005/0166298 A1 * 8/2005 Pieroranzio ..... A41D 1/06 2/69
2006/0212989 A1 9/2006 White
2006/0260022 A1 * 11/2006 Vaughn ..... A41D 19/0017 2/163
2007/0028362 A1 2/2007 Cash
2008/0196140 A1 8/2008 Mayerson et al.
2009/0178174 A1 * 7/2009 Cash, Jr. ..... A41D 27/28 2/243.1
2009/0205550 A1 * 8/2009 George ..... A41D 15/002 112/475.24
2012/0060256 A1 * 3/2012 Parker ..... A41D 3/02 2/85
2012/0304361 A1 * 12/2012 Jeffords ..... A41D 27/08 2/227
2016/0095367 A1 * 4/2016 Curran ..... A41D 1/084 2/243.1
2016/0198778 A1 * 7/2016 Hines ..... C08K 5/07 2/269
2017/0119073 A1 * 5/2017 Horner ..... A41B 7/00
2017/0290382 A1 * 10/2017 Arnold ..... A41D 1/04
2018/0020751 A1 * 1/2018 Lewis ..... A41D 27/201 2/69
2018/0310648 A1 * 11/2018 Rhodes ..... A41D 27/10
2019/0142084 A1 * 5/2019 Kermani ..... A41D 19/0041 2/456

FOREIGN PATENT DOCUMENTS

CN 202385792 U 8/2012
CN 202774272 U 3/2013
CN 203538403 U 4/2014
CN 204409688 U 6/2015
CN 206852074 U 1/2018
FR 2529760 A1 1/1984

OTHER PUBLICATIONS

"Miceman—Aspire to Inspire Before You Expire. Live to Inspire." http://miceman.blogspot.com/2013/12/blo g-post_19.html.
"The North Face Summit Series L6 Down Jacket | First Look" outdoorsmagic.com, Monday Feb. 20, 2017. https://outdoorsmagic.com/reviews/north-face-summit-series-I6-jacket-first-look/.
International Search Report and Written Opinion received for PCT Patent Application No. PCT/US2019/055424, dated Jan. 20, 2020, 12 pages.
International Preliminary Report on Pantentability received for PCT Patent Application No. PCT/US2019/055424, dated May 20, 2021, 9 pages.
Office Action received for Canadian Patent Application No. 3114207, dated Jun. 1, 2022, 4 pages.
Intention to Grant received for European Patent Application No. 19797870.3, dated Jul. 25, 2022, 6 pages.
Office Action received for Canadian Patent Application No. 3,114,207, dated Jan. 4, 2023, 4 pages.

* cited by examiner

SLEEVE WITH INTEGRATED INSERT

CROSS-REFERENCE TO RELATED APPLICATIONS

This application, having Ser. No. 16/579,100 and entitled "Sleeve with Integrated Insert," claims the benefit of priority of U.S. Provisional Application No. 62/755,920, entitled "Sleeve with Integrated Insert," and filed Nov. 5, 2018. The entirety of the aforementioned application is incorporated by reference herein.

TECHNICAL FIELD

Aspects herein are directed to a sleeve with an integrated insert.

BACKGROUND

Traditional sleeves, whether incorporated into an upper body garment or as a stand-alone article, generally cover a wearer's arm and terminate at a single opening positioned proximate to a wearer's wrist. Traditional sleeves have a fixed length and cover a fixed amount of a wearer's arm and thus generally do not provide protection from environmental conditions (e.g., temperature, wind, etc.) to certain portions of a wearer's limb (e.g., hand, fingers, etc.).

DESCRIPTION OF THE DRAWINGS

Examples of aspects herein are described in detail below with reference to the attached drawing figures, wherein.

DETAILED DESCRIPTION

Figure 1:
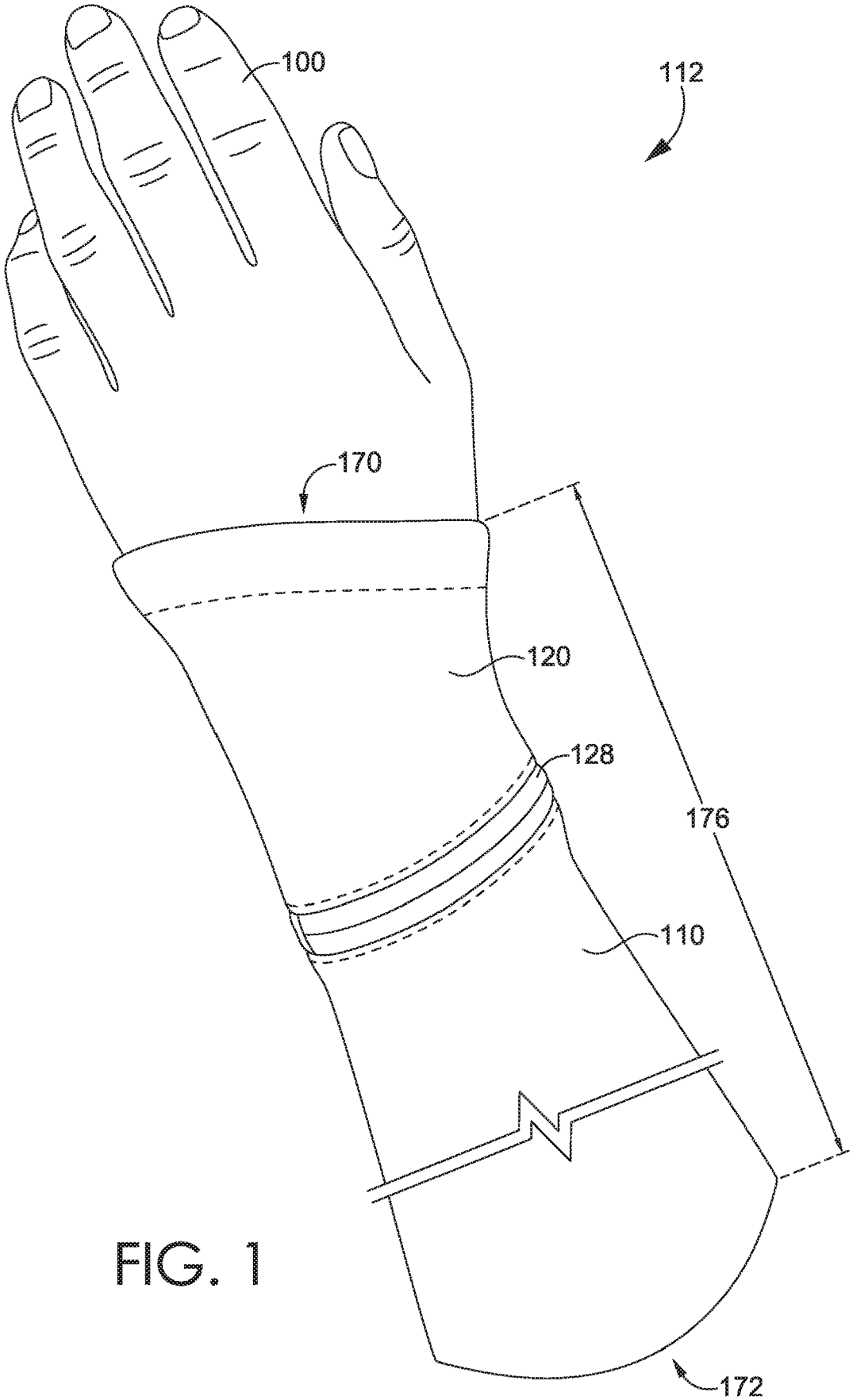
FIG. 1 illustrates a posterior view of a wearer wearing a sleeve having an integrated insert in a retracted state, in accordance with aspects herein.

The subject matter of the present invention is described with specificity herein to meet statutory requirements. However, the description itself is not intended to limit the scope of this disclosure. Rather, the inventors have contemplated that the claimed or disclosed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

At a high level, aspects herein are directed to a sleeve having a first opening opposite a second opening at opposing ends of the sleeve, the sleeve also having a third opening proximate a distal end of the sleeve, an insert affixed to the sleeve proximate the third opening, and a releasable fastener configured to close the third opening and maintain the insert interior to the sleeve. The sleeve thus described has a first length when the releasable fastener is fastened and the insert is maintained interior to the sleeve and also has a second length when the releasable fastener is unfastened. Thus, the sleeve may cover the same portion of a wearer's arm as a typical sleeve when the releasable fastener is fastened and the insert is maintained interior to the sleeve, but may then expand to cover more of the wearer's arm when the releasable fastener is unfastened.

Positional terms as used herein to describe the sleeve such as "front," "back," "upper," "proximal," "distal," "anterior," "posterior," "lower," "bottom," "interior," "exterior," and the like are to be given their customary meaning with respect to an appropriately sized sleeve worn as intended and as shown and described herein by a wearer standing in an anatomical position. With respect to the term "anatomical position," a wearer's arms would be positioned at the wearer's sides with the wearer's palms facing forward. In this position, the wearer's thumbs would extend laterally. The terms "distal end" and "proximal end" when used in relation to an end of the sleeve may mean a terminal edge of the sleeve. Such terms may further mean a portion of the sleeve within about 10 centimeters of the terminal edge of the sleeve. The term "about" when used in relation to measurements means within ±10% of a designated value. The term "proximate" when used in relation to positions means within ±10 centimeters of a designated position. Terms such as "attached," "secured," "affixed," and the like may mean elements that are releasably attached to one another using, for example, snap systems, slider systems, hook-and-loop closure systems, releasable adhesives, buttons, hooks, and the like. These terms may further mean elements that are permanently attached to one another using, for example, stitching, bonding, welding, and the like. The terms "axial direction" and "longitudinal direction" are used interchangeably herein and mean the direction the sleeve extends from a proximal end of the sleeve to a distal end of the sleeve.

The term "mesh," or "mesh material" as used herein may mean a textile having a large number of closely spaced holes. Aspects herein contemplate that the mesh material may be formed from a loosely knitted or woven textile, or the mesh material may be formed by perforating a textile in a post-weaving or post-knitting step to form the holes. The term "first sleeve state" as used herein refers to the sleeve when the releasable fastener is fastened such that the insert is contained within the sleeve and the sleeve has a first length. And the term "second sleeve state" as used herein refers to the sleeve when the releasable fastener is unfastened such that the insert is not contained within the sleeve and the sleeve has a second length. The term "releasable fastener" as used herein refers to a fastener system that can be repeatedly coupled and uncoupled to respectively secure or disengage components from each other. An example releasable fastener may comprise, buttons, snaps, hook-and-loop fasteners, slider systems including zippers, and the like. In line with this, the term "complementary" when describing components of a releasable fastener system means components having structures that mechanically engage with each other.

The term "elastomeric" as used herein when describing yarns generally means a yarn type that may provide a maximum stretch greater than about 200% under load prior to returning to its non-stretched state when the load is removed, and some elastomeric yarns provide a maximum stretch of about 400%. Examples of elastomeric yarn types include, Lycra®, elastane, spandex, rubber, and the like.

Figure 2:
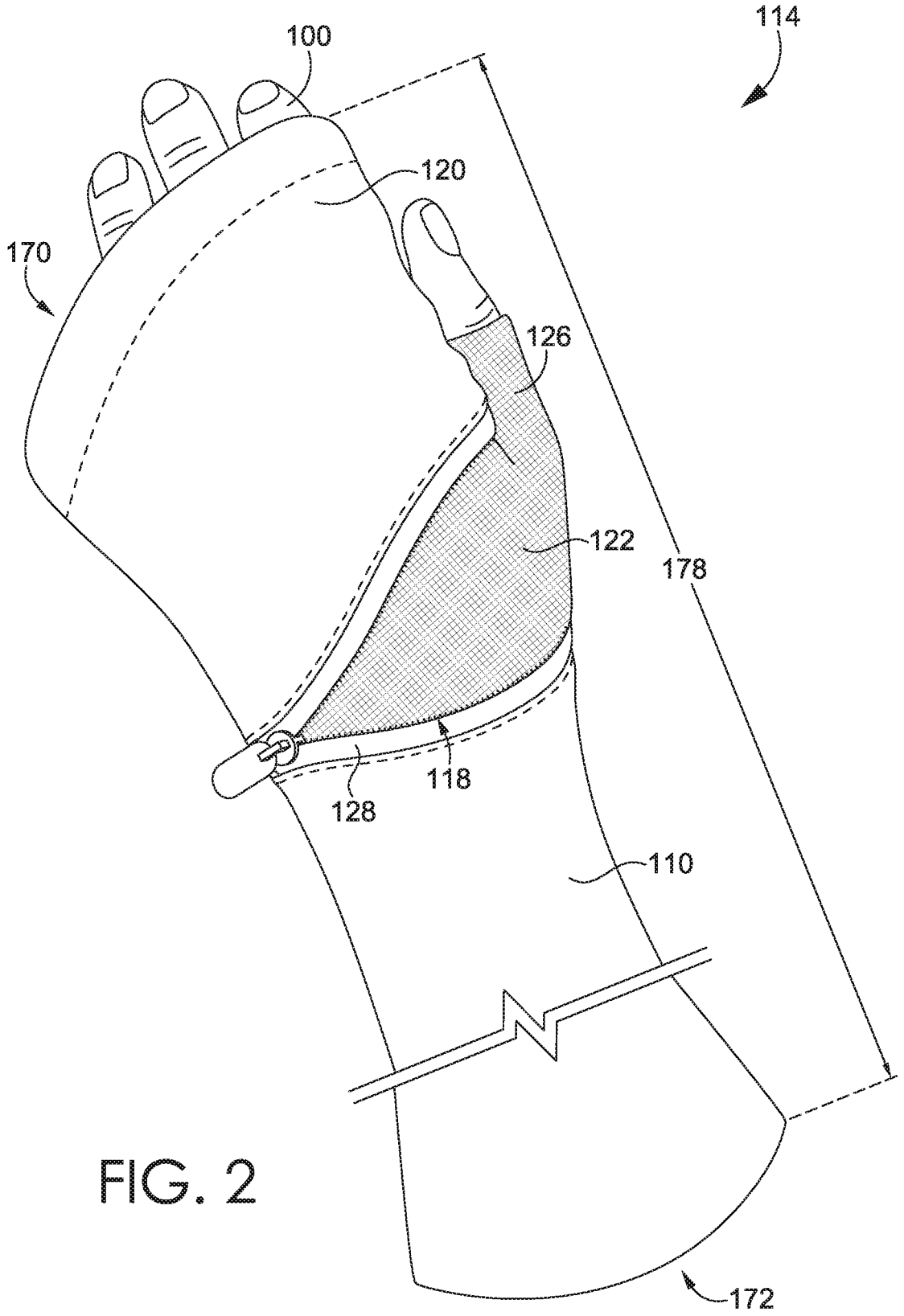
FIG. 2 illustrates a posterior view of a wearer wearing the sleeve of FIG. 1 in an extended state, in accordance with aspects herein.
Figure 3:
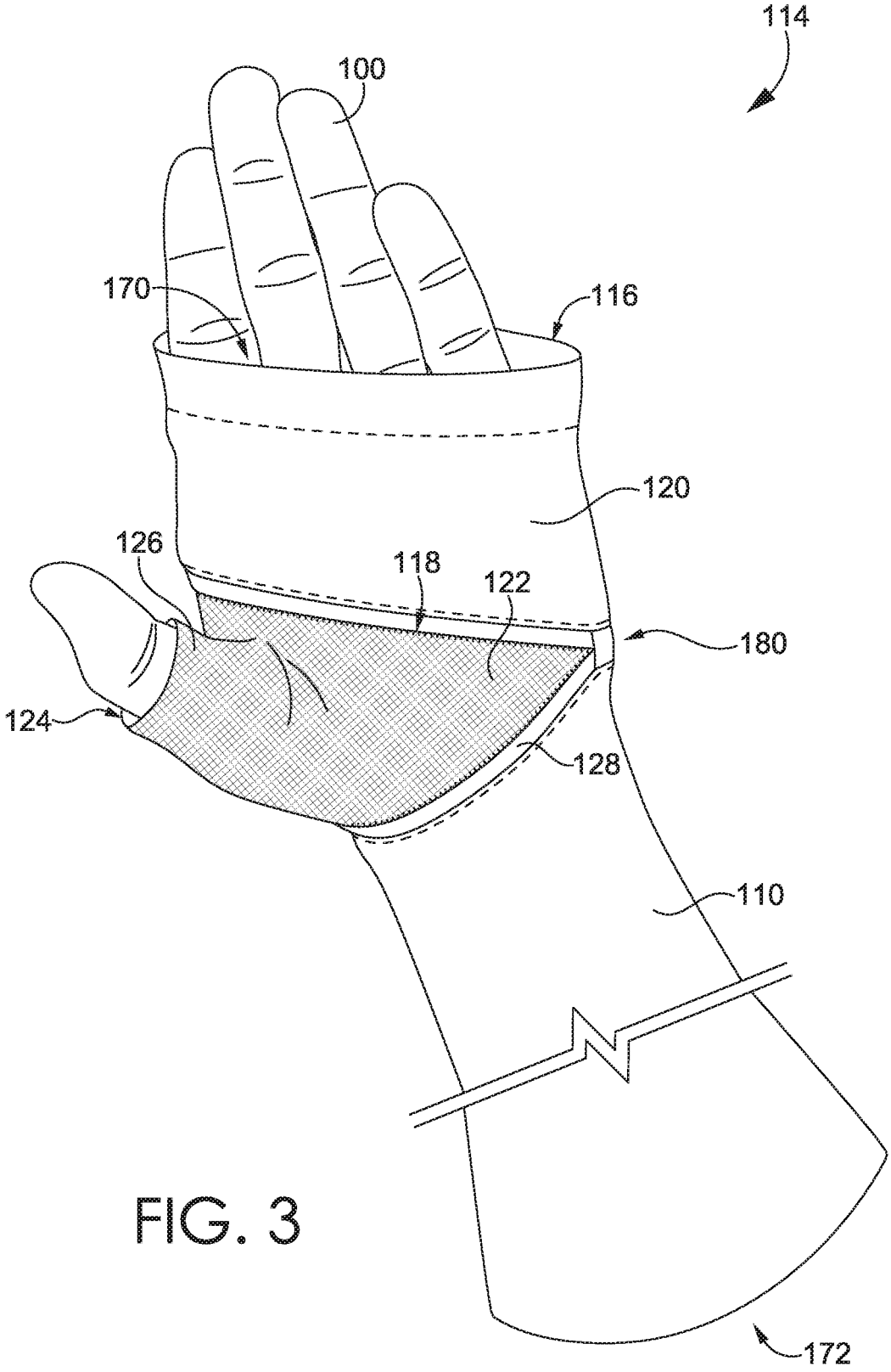
FIG. 3 illustrates an anterior view of a wearer wearing the sleeve of FIG. 1 in the extended state of FIG. 2, in accordance with aspects herein.

Turning now to FIGS. 1-3, a wearer 100 is shown wearing a sleeve 110 in the first sleeve state 112 (FIG. 1) and in the second sleeve state 114 (FIGS. 2 and 3). The sleeve 110 includes a distal end 170 and a proximal end 172 opposite the distal end 170, a first opening 116 at the distal end 170, and a second opening (not shown) at the proximal end 172. In some aspects, the proximal end 172 of the sleeve 110 may be affixed to an upper body garment (e.g., shirt, jacket, and the like). In other aspects, the sleeve 110 may be integrally formed with an upper body garment. In still other aspects, the sleeve 110 is a stand-alone article worn separately by the wearer 100. The illustrated aspect depicts the sleeve 110 as tubular and having a cylindrical wall extending longitudinally between the proximal end 172 and the distal end 170. In other aspects, the sleeve 110 may have a wall of another geometry (e.g., a polygonal shape, an irregular shape, and the like) extending longitudinally between the proximal end 172 and the distal end 170.

The sleeve 110 also includes a third opening 118 positioned proximate the distal end 170. The third opening 118 may be of any suitable size and shape. The third opening 118 may be positioned from about 2 cm to about 16 cm from the distal end 170 of the sleeve 110, as illustrated in FIGS. 2 and 3. The longitudinal length of the sleeve 110 may change as a result of the third opening 118. That is, when the third opening 118 is substantially closed (as seen in FIG. 1) the sleeve has a first length 176. When the third opening 118 is opened and the distal end 170 of the sleeve 110 is pulled distally (as seen in FIGS. 2 and 3) the sleeve has a second length 178 that is greater than the first length 176.

For example, the sleeve 110 in the first sleeve state 112 may extend from the proximal end 172 to the distal end 170 and terminate about the wrist of the wearer 100. The sleeve 110 in the second sleeve state 114, however, may terminate at a point distal to the wrist of the wearer 100. The third opening 118 allows a portion 120 of the distal end 170 of the sleeve 110 to extend forward and cover a portion of the wearer's 100 limb distal to their wrist (e.g., hand, fingers). In some aspects, the portion 120 hinges forward with respect to a fixed anchor point 180 located on the medial side of the sleeve 110. In these aspects, the length of only part of the distal end 170 of the sleeve 110 increases as measured from the proximal end 172. For example, the length of the sleeve 110 along a medial side of the sleeve 110 may not change between the first sleeve state 112 and the second sleeve state 114 while the length of the sleeve 110 along a lateral side of the sleeve 110 may change between said states. Hinging about the fixed anchor point 180 may maintain the integrity of the sleeve 110. Hinging about the fixed anchor point 180 may also make it easier to recouple the distal end 170 to the sleeve 110 than a construction where the distal end 170 completely disengages from the sleeve 110 (whether completely separate or connected only by insert 122). Positioning the fixed anchor point 180 on the medial side may allow more expansion on the lateral side of the sleeve 110 which is advantageous because of the location of the wearer's thumb (e.g., additional expansion proximate the wearer's thumb may allow the wearer to more easily extend their thumb through a thumb portion).

An insert 122 may be affixed to the sleeve 110 to prevent, limit, or restrict communication through the third opening 118. Thus, the insert 122 may also provide warmth or other protection from an exterior environment when the sleeve 110 is in the second sleeve state 114. The insert 122 may comprise a panel of fabric affixed to the sleeve 110. In other aspects the insert 122 may be integrally formed with the sleeve 110. In some aspects, the insert 122 may be attached to the sleeve 110 around a perimeter of the third opening 118. For example, the insert 122 may be affixed to an interior surface of the cylindrical wall of the sleeve 110 proximate the third opening 118. The insert 122 may include a thumb opening 124 allowing the wearer's 100 thumb to extend from an interior chamber of the sleeve 110 to an exterior point. In some aspects, the insert 122 includes a thumb channel 126 through which the wearer's 100 thumb may extend. The thumb opening 124 may be located at a distal end of the thumb channel 126. The thumb channel 126 may cover a portion of the wearer's 100 thumb but leave a distal portion thereof exposed, thus providing some additional coverage without completely covering the thumb. This configuration may be advantageous when the wearer 100 is performing a task requiring dexterity and their sense of feel/touch is important. In some aspects the thumb channel 126 may comprise a cylindrical sheath. The cylindrical sheath may have a frustoconical shape. In other aspects, the insert 122 may have a thumb channel 126 that completely covers the wearer's 100 thumb. This configuration may be advantageous when protection from an exterior environment is important. Any and all aspects, and any variation thereof, are contemplated as being within the scope herein.

The third opening 118 may be held in a closed position by a releasable fastener 128. The releasable fastener 128 may be spaced a first distance from the distal end 170 of the sleeve 110. In the illustrated aspect, the releasable fastener 128 comprises a zipper system having a first zipper tape and a second zipper tape fastened to the sleeve 110 around the perimeter of the third opening 118. Thus, the illustrated aspect of the sleeve 110 is in the first sleeve state 112 when the zipper is closed and is in the second sleeve state 114 when the zipper is open. In other aspects, other types of releasable fasteners may be used, even if such releasable fasteners do not completely seal the third opening 118. For example, a button may be affixed to the sleeve 110 on one side of the third opening 118 and a loop or button hole may be positioned on the sleeve 110 on an opposing side of the third opening 118. In this example, the sleeve 110 may be in the first sleeve state 112 when the button is received through the loop or the button hole even though the third opening 118 would not be completely closed. This example demonstrates that the releasable fastener 128 may provide more than one function. That is, when fastened the releasable fastener 128 may restrict the length of the sleeve 110 by preventing the portion 120 from hinging distally. In some aspects, when fastened the releasable fastener 128 may also seal the insert 122 within an interior cavity of the sleeve 110.

The sleeve 110 and the insert 122 may be comprised of any suitable material. In some aspects, both of the sleeve 110 and the insert 122 are made of the same material. In other aspects, the sleeve 110 is made from a different material than the insert 122. For example, the sleeve 110 may be comprised of a panel of woven material and the insert 122 may be comprised of a mesh material. One, or both, of the sleeve 110 and the insert 122 may be made from an elastomeric material. Likewise, one, or both, of the sleeve 110 and the insert 122 may be comprised of a woven material or a knit material.

Figure 4:
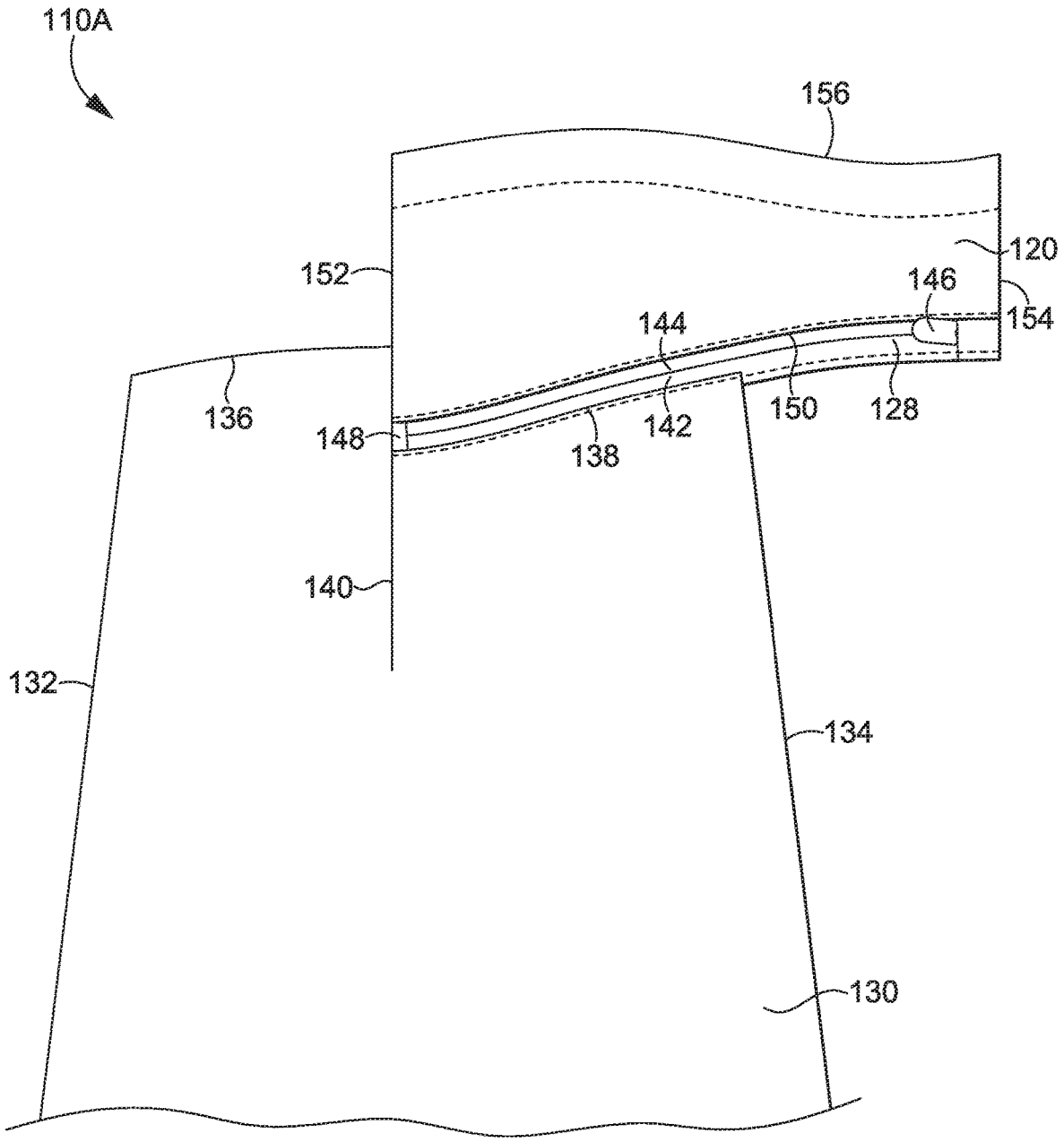
FIG. 4 illustrates an exterior side of a sleeve laid flat after two seams have been unjoined, in accordance with aspects herein.
Figure 5:
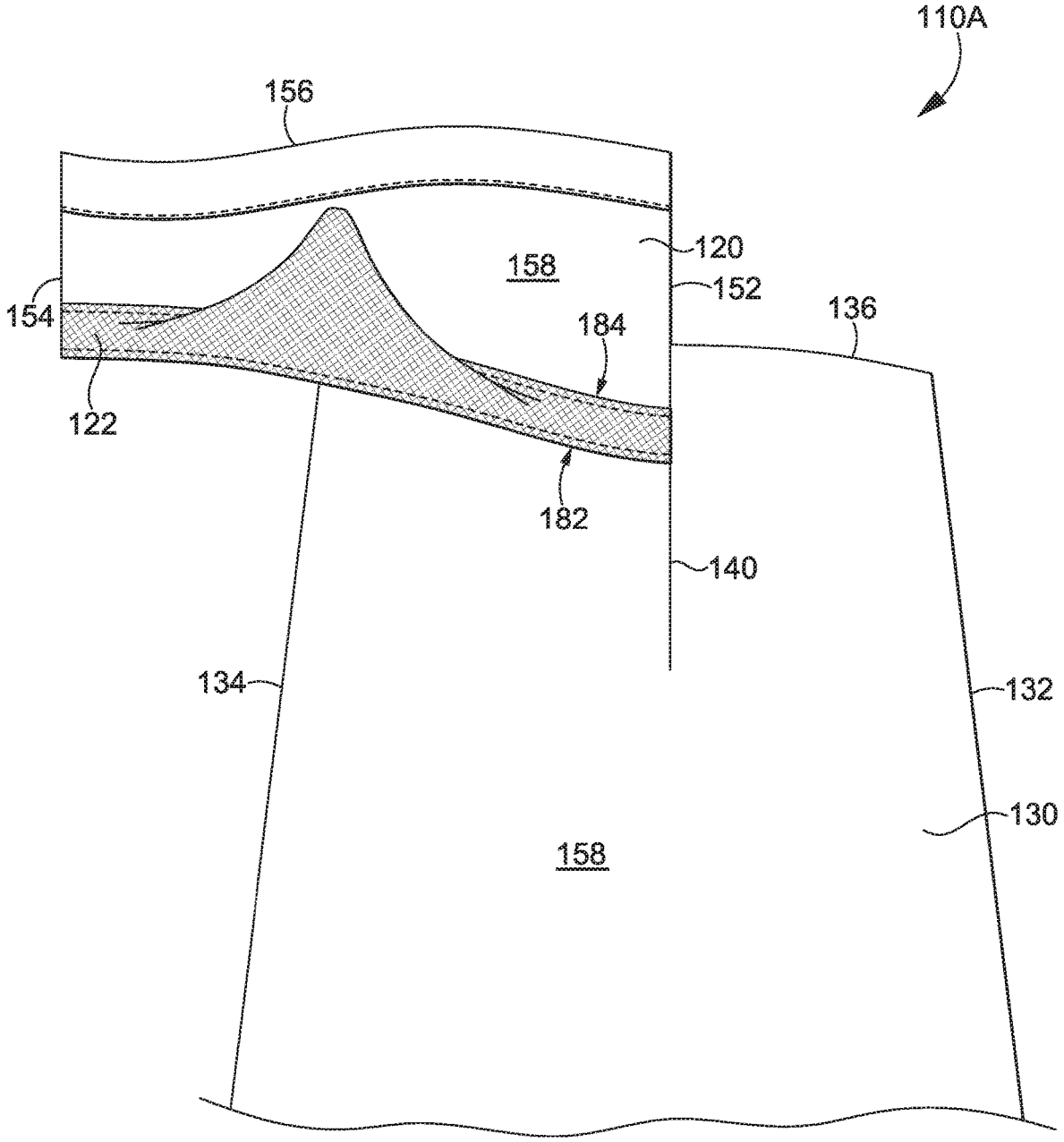
FIG. 5 illustrates an interior side of the sleeve of FIG. 4 laid flat after two seams have been unjoined, in accordance with aspects herein.
Figure 6:
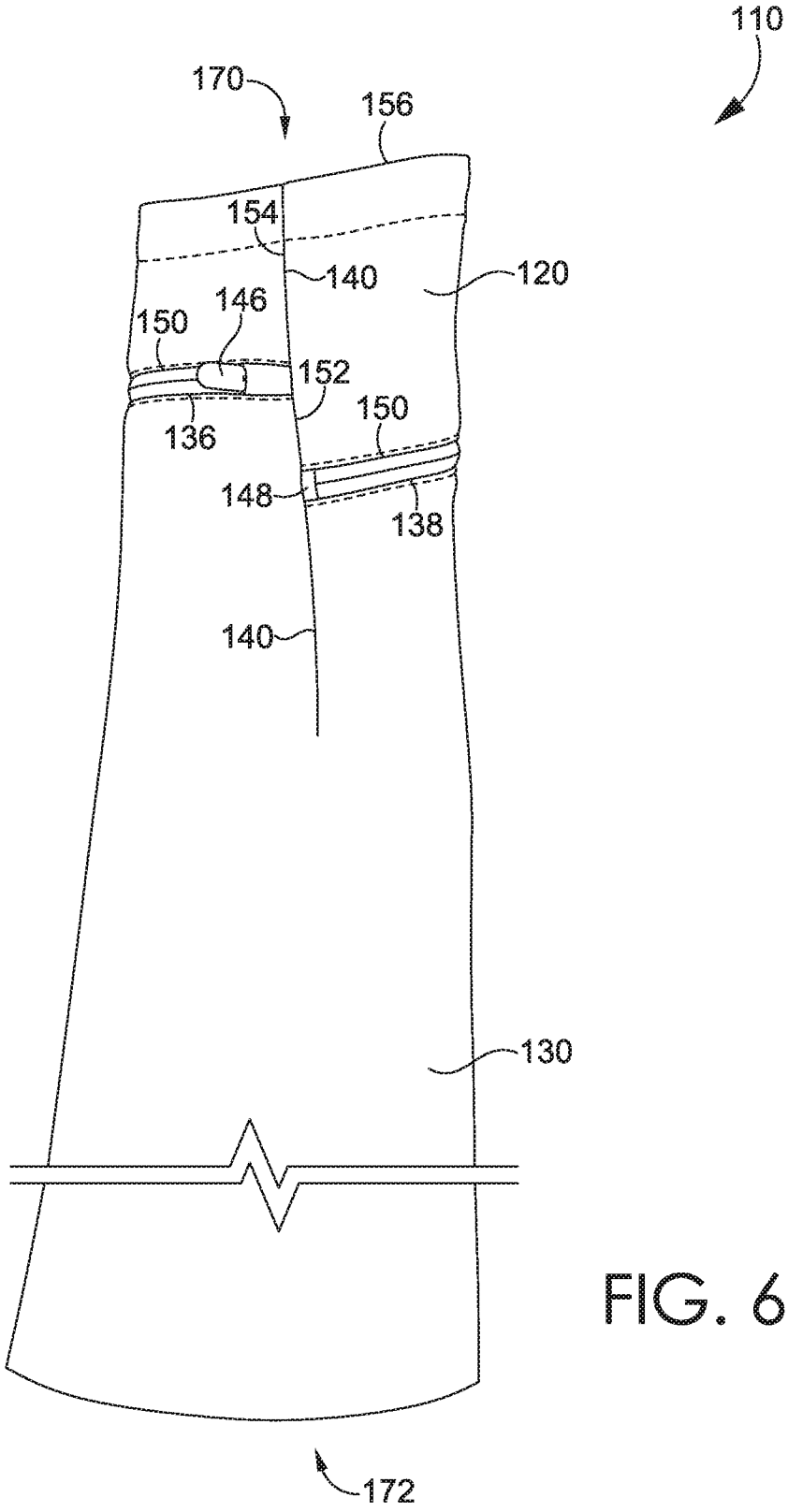
FIG. 6 is a medial side view of the sleeve of FIG. 4 after the two seam have been rejoined, in accordance with aspects herein.

Turning now to FIGS. 4-6, one manner of construction of the sleeve 110 will be described. FIG. 4 illustrates an exterior side of an unassembled sleeve 110A laid flat, but having the releasable fastener 128 attached as shown. FIG. 5 illustrates an interior side of the unassembled sleeve 110A. In this aspect, the sleeve 110 is comprised of a first panel 130, the portion 120, the insert 122 and the releasable fastener 128. The first panel 130 includes a first edge 132 that may be joined to a second edge 134 at a seam (not shown) when the sleeve 110 is assembled. The first panel 130 also includes a staggered distal edge comprised of a first distal edge 136 and a second distal edge 138. The staggered distal edge may include the first distal edge 136 being positioned distal to the second distal edge 138 such that the two distal edges are staggered in the axial direction of the sleeve 110. As discussed below, the staggered distal edge may allow the third opening 118 to be formed in a direction that is not normal to the axial direction of the sleeve 110. In some aspects, the third opening 118 may be formed by making an incision in the sleeve 110 at a desired position. In other aspects, the third opening 118 may be formed by attaching separate panels together via a releasable fastener (e.g., a first panel and a second panel connected with opposing zipper tapes with the panels also joined at seams to form a sleeve). In some aspects, an incision is made in a longitudinal direction of the sleeve 110 from the staggered distal edge proximally up the first panel 130. A seam 140 may close this incision and provide increased strength to the sleeve 110 and the connection between components proximate thereto.

One, or both, of the first distal edge 136 and the second distal edge 138 may extend normal to the longitudinal direction of the sleeve 110. In other aspects, such as the illustrated aspect, the first distal edge 136 and/or the second distal edge 138 may not extend normal to the longitudinal direction of the sleeve 110. In such aspects, when the sleeve 110 is in the first sleeve state 112, the edges of the third opening 118 may be positioned proximate to one another such that the third opening 118 may resemble a line extending across a portion of the sleeve 110. In these aspects, such line may extend around a portion of the sleeve in a helical manner where one end of the line is distal to the other end of the line, as seen in FIG. 6. The direction the line extends, whether normal to the longitudinal direction of the sleeve 110, or not, controls both the amount the distal end 170 may hinge and the direction the distal end 170 may hinge. For example, having the line extend in a helical direction, as shown in FIG. 6, may allow the distal end 170 to hinge in a manner that conforms more closely to the typical wearer's anatomy (e.g., the shape of the wearer's limb).

The releasable fastener 128 shown in the illustrated aspect comprises a zipper system having a first zipper tape 142, a second zipper tape 144, and a slider having a pull tab 146. The first zipper tape 142 may be joined to the second zipper tape 144 at a first stop 148 and a second stop (not shown). The first stop 148 and the second stop may be at opposite ends of the zipper tapes 142 and 144. In other aspects, the first zipper tape 142 may not be joined to the second zipper tape 144 at a second stop. In these aspects, each of the first zipper tape 142 and the second zipper tape 144 have their own separate second stop. The first zipper tape 142 may be affixed in part to the first distal edge 136 and in part to the second distal edge 138 as shown in FIG. 6. In the aspect shown in FIG. 6, both of the first stop 148 and the second stop may be adjacent to the seam 140 but longitudinally offset from one another such that the first stop 148 is proximal to the second stop (which is covered, but would be next to the pull tab 146). In this way, the third opening 118 may be closed with the zipper system and the zipper system may extend around a portion of the sleeve 110 in a helical manner as discussed above.

The portion 120 may include a proximal edge 150, a first side edge 152, a second side edge 154 and a distal edge 156. The second zipper tape 144 may be affixed to the proximal edge 150 of the portion 120. Part of the first side edge 152 may be joined to the first panel 130 at the seam 140. In some aspects, the seam 140 may continue distally up the sleeve 110 and join the remainder of the first side edge 152 to the second side edge 154 as shown in FIG. 6. The distal edge 156 may be the distal end 170 of the sleeve 110. In aspects, the distal end 170 of the portion 120 may be folded back and secured to an interior portion of the sleeve 110 (i.e., the distal end 170 may be hemmed). In such aspects, the fold defines the distal edge 156 of the portion 120.

The insert 122 may be affixed to the zipper system. For example, the insert 122 may include a proximal edge 182 affixed to the first zipper tape 142 and a distal edge 184 affixed to the second zipper tape 144. The insert 122 may have an insert width extending between the proximal edge 182 and the distal edge 184 (shown more clearly in FIGS. 2 and 3). In example aspects, an entire length of each of the proximal edge 182 and the distal edge 184 of the insert 122 may be affixed to a respective zipper tape. In some aspects, the length of the proximal edge 182 may be different from the length of the distal edge 184 of the insert 122, while in other aspects the length is the same. When the zipper is opened, the insert 122 may provide coverage to wearer's limb while allowing the first zipper tape 142 to pull away from the second zipper tape 144, as opposed to a third opening 118 not having an insert 122. When the sleeve 110 is in the second sleeve state 114, the thumb opening 124 may be eccentrically positioned with respect to the length of the insert 122 such that it is located on a lateral aspect of the insert 122. In other aspects, the insert 122 may be affixed to an interior surface 158 of the sleeve 110. For example, the insert 122 may be affixed to the interior surface 158 proximate the first distal edge 136 and the second distal edge 138 of the first panel 130 and the proximal edge 150 of the portion 120.

In use, a wearer 100 may pass a limb through the sleeve 110. The proximal end 172 of the sleeve 110 may be positioned proximate the shoulder of the wearer 100 when the sleeve 110 is in the as-worn position. The distal end 170 of the sleeve 110 may be positioned at a first position proximate the wrist of the wearer 100 when the sleeve 110 is in the as-worn position and the sleeve 110 is in the first sleeve state 112 (seen in FIG. 1). If more coverage of the limb is desirable, the wearer 100 may unfasten the releasable fastener 128 and pull the distal end 170 of the sleeve 110 distally to cover a portion of the limb distal to the first position. In some aspects, the wearer 100 may extend their thumb through the thumb channel 126 of the insert 122 and out of the thumb opening 124. To return the sleeve from the second sleeve state 114 (seen in FIG. 2) to the first sleeve state 112 (seen in FIG. 1), the wearer may remove their thumb from the thumb channel 126, position the insert 122 interior to the sleeve 110 and fasten the releasable fastener 128.

Figure 7:
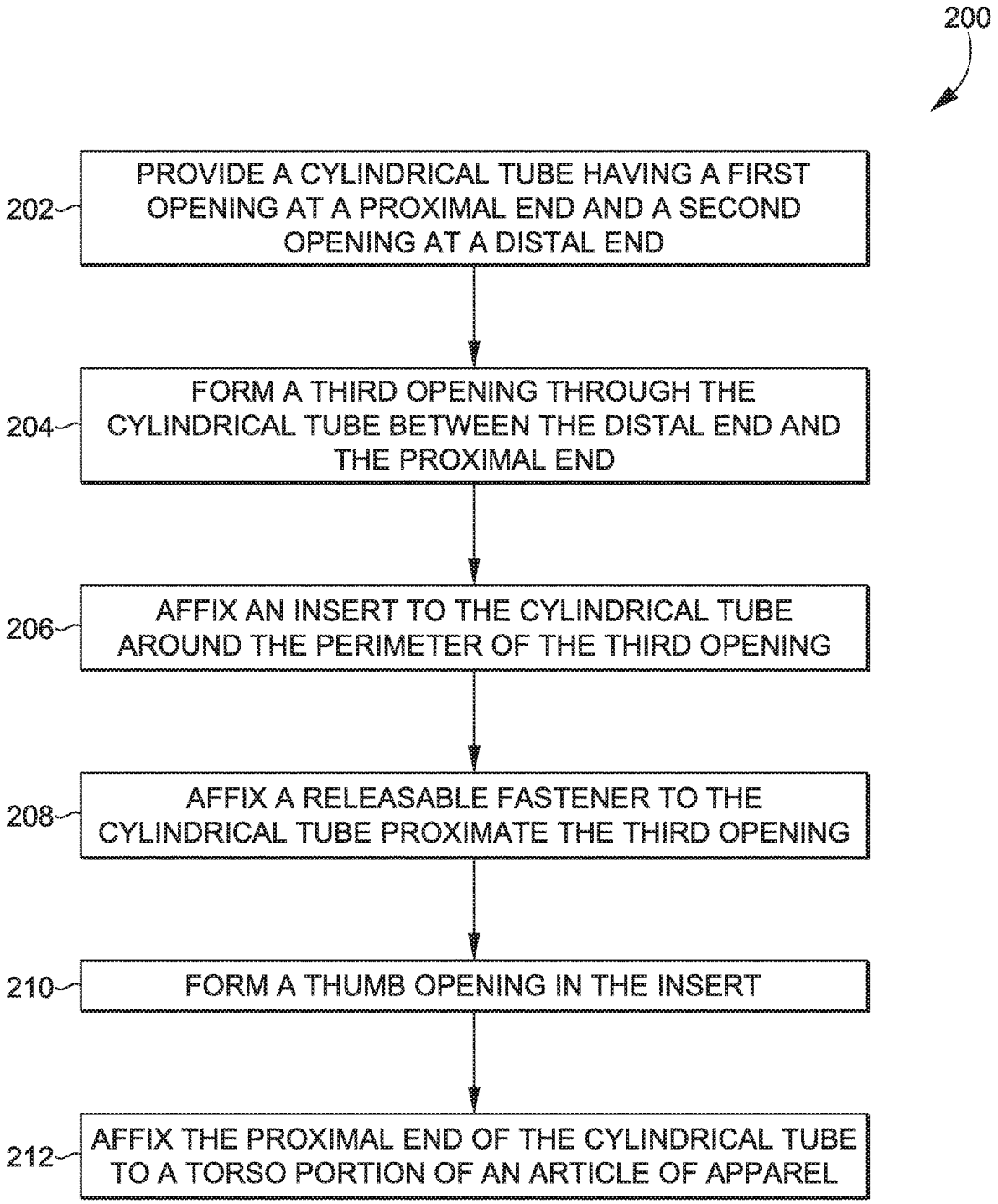
FIG. 7 is a flow diagram of an example method of manufacturing a sleeve having an integrated insert, in accordance with aspects herein.

Another aspect of a method 200 of manufacturing a sleeve having an integrated insert is illustrated in FIG. 7. The method 200 may include the step of providing a cylindrical tube having a first opening at a proximal end and a second opening at a distal end, as seen at block 202. The distal end may be opposite from the proximal end. The method 200 may further include the step of forming a third opening in the cylindrical tube between the distal end and the proximal end, as seen at block 204. The third opening may have a perimeter. The method 200 may include step of affixing an insert to the cylindrical tube around the perimeter of the third opening, as seen at block 206. The method 200 may further include the step of affixing a releasable fastener to the cylindrical tube proximate the third opening, as seen at block 208. The sleeve may have a first length when the sleeve is in an extended state. The sleeve may have a second length when the sleeve is in a retracted state. The first length may be longer than the second length.

In some aspects, the method 200 may include the step of forming a thumb opening in the insert, as seen at block 210. In other aspects, the method 200 may include the step of affixing the proximal end of the cylindrical tube to a torso portion of an article of apparel, as seen at block 212. The article of apparel may comprise a jacket.

Figure 8:
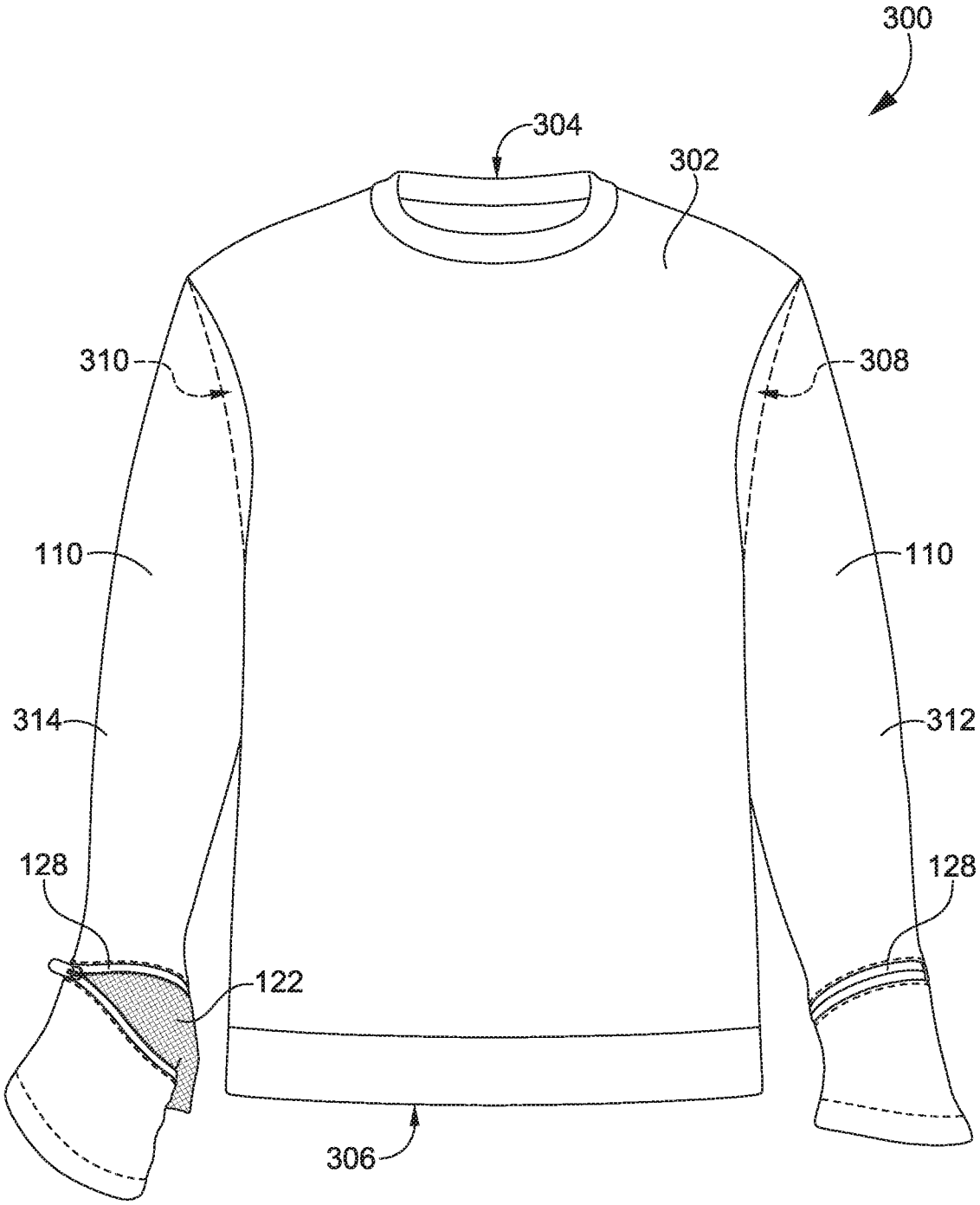
FIG. 8 illustrates a front view of an upper body garment having a pair of sleeves that each include an integrated insert, in accordance with aspects herein.

As discussed above, the sleeve 110 may be incorporated into an upper torso garment. One aspect of an upper torso garment 300 is depicted in FIG. 8. The upper torso garment 300 includes a torso portion 302 that includes a front aspect and a back aspect that define a neck opening 304, a waist opening 306, a first sleeve opening 308, and a second sleeve opening 310. The upper torso garment 300 further includes a first sleeve 312 and a second sleeve 314. The first sleeve 312 may be coupled to the a torso portion 302 at the first sleeve opening 308. The second sleeve 314 may be coupled to the torso portion 302 at the second sleeve opening 310. In other aspects, the first sleeve 312 and the second sleeve 314 may be integrally formed with the torso portion 302.

Each of the first sleeve 312 and the second sleeve 314 may include each of the features the sleeve 110 described above in reference to FIGS. 1-6. Thus, the first sleeve 312 and the second sleeve 314 each may include an insert 122 affixed around a perimeter of a third opening in said sleeve. Further, the first sleeve 312 and the second sleeve 314 each may include a releasable fastener 128 that may hold said sleeve in a retracted state or may allow said sleeve to move to an extended state. For example, in the illustrated aspect the first sleeve 312 is shown in the retracted state where the releasable fastener 128 is fastened. Likewise, in the illustrated aspect the second sleeve 314 is shown in the extended state where the releasable fastener 128 is unfastened and the insert 122 is exposed.

The following clauses represent example aspects of concepts contemplated herein. Any one of the following clauses may be combined in a multiple dependent manner to depend from one or more other clauses. Further, any combination of dependent clauses (clauses that explicitly depend from a previous clause) may be combined while staying within the scope of aspects contemplated herein. The following clauses are examples and are not limiting.

Clause 1. A sleeve comprising:

a cylindrical tube having a first opening at a proximal end and a second opening at a distal end, the distal end being opposite the proximal end, the cylindrical tube further comprising a third opening through the cylindrical tube, the third opening positioned proximate the second opening;

an insert having one or more perimeter edges, each of the one or more perimeter edges coupled to the cylindrical tube proximate a perimeter of the third opening; and a releasable fastener coupled proximate to the perimeter of the third opening.

Clause 2. The sleeve of clause 1, wherein the cylindrical tube is comprised of a knit or woven fabric.

Clause 3. The sleeve of any of the preceding clauses, wherein the one or more perimeter edges of the insert are affixed to a perimeter edge of the third opening.

Clause 4. The sleeve of any of the preceding clauses, wherein the insert includes a cylindrical sheath configured to receive a thumb.

Clause 5. The sleeve of clause 4, wherein the cylindrical sheath includes an aperture at a distal end of the cylindrical sheath.

Clause 6. The sleeve of any of the preceding clauses, wherein the insert is affixed to an interior surface of the cylindrical tube proximate the perimeter of the third opening.

Clause 7. The sleeve of any of the preceding clauses, wherein the insert is integrally formed with the cylindrical tube.

Clause 8. The sleeve of any of the preceding clauses, wherein the insert is exposed through the third opening when the releasable fastener is unfastened.

Claus 9. The sleeve of any of the preceding clauses, wherein the insert is stowed within the sleeve when the releasable fastener is fastened.

Clause 10. An extendable sleeve comprising:

a cylindrical tube having a first opening at a proximal end, a second opening at a distal end, the distal end being opposite the proximal end, and a third opening through the cylindrical tube between the distal end and the proximal end;

an insert affixed to the cylindrical tube proximate a perimeter of the third opening; and a releasable fastener coupled to the sleeve proximate the third opening, wherein the sleeve is in an extended state when the releasable fastener is unfastened, and wherein the sleeve is in a retracted state when the releasable fastener is fastened.

Clause 11. The sleeve of any of the preceding clauses, wherein the releasable fastener comprises a zipper system.

Clause 12. The sleeve of clause 11, wherein the zipper system includes a first zipper tape and a second zipper tape, wherein the first zipper tape is affixed to the cylindrical tube around a first portion of the perimeter of the third opening, and wherein the second zipper tape is affixed to the cylindrical tube around a second portion of the perimeter of the third opening.

Clause 13. The sleeve of any of clauses 11-12, wherein the zipper system extends around a portion of the cylindrical tube in a direction normal to an axial direction of the cylindrical tube when the sleeve is in the retracted state.

Clause 14. The sleeve of any of clauses 11-13, wherein the zipper system is positioned proximate a wearer's wrist when the sleeve is in the retracted state in an as-worn configuration.

Clause 15. The sleeve of any of clauses 11-14, wherein the zipper is spaced a first distance from the distal end of the cylindrical tube.

Clause 16. The sleeve of any of clauses 11-15, wherein the distal end of the cylindrical tube can be pulled in an axial direction of the cylindrical tube to move the sleeve to the extended state after the zipper has been unfastened.

Clause 17. The sleeve of any of clauses 10-16, wherein a portion of a wearer's hand is covered by the distal end of the cylindrical tube when the sleeve is in the extended state in an as-worn configuration.

Clause 18. The sleeve of any of the clauses 10-17, wherein the insert is exposed when the sleeve is in the extended state.

Clause 19. A method of manufacturing a sleeve having an integrated insert, the method comprising:

providing a cylindrical tube having a first opening at a proximal end and a second opening at a distal end, the distal end being opposite the proximal end;

forming a third opening through the cylindrical tube between the distal end and the proximal end, the third opening having a perimeter;

affixing an insert to the cylindrical tube around the perimeter of the third opening; and affixing a releasable fastener to the cylindrical tube proximate the third opening, wherein the sleeve has a first length when the sleeve is in an extended state, wherein the sleeve has a second length when the sleeve is in a retracted state, wherein the first length is longer than the second length.

Clause 20. The method of manufacturing a sleeve having an integrated insert of clause 19, further comprising forming a thumb opening in the insert.

Clause 21. The method of manufacturing a sleeve having an integrated insert of any of clauses 19-20, further comprising affixing the proximal end of the cylindrical tube to a torso portion of an article of apparel.

Clause 22. The method of manufacturing a sleeve having an integrated insert of any of clauses 19-21, wherein the article of apparel comprises a jacket.

Clause 23. An upper torso garment comprising:

a torso portion having a front aspect and a back aspect that define a neck opening, a waist opening, a first sleeve opening, and a second sleeve opening;

a sleeve extending from the first sleeve opening, the sleeve comprising a tube extending distally from the torso portion to a distal end, the sleeve further comprising a distal opening at the distal end and a lateral opening positioned proximate the distal end, wherein the lateral opening is opened in a first state of the sleeve and the lateral opening is closed in a second state of the sleeve;

an insert having a first portion and a second portion, the first portion comprising a panel affixed to a perimeter of the lateral opening, the second portion having a cylindrical sheath configured to receive a thumb shape; and a releasable fastener coupled to the sleeve proximate the lateral opening, wherein the releasable fastener is unfastened in the first state of the sleeve and the releasable fastener is fastened in the second state of the sleeve.

Clause 24. The upper torso garment of clause 23, wherein the cylindrical sheath includes an aperture at a distal end of the cylindrical sheath.

Clause 25. The upper torso garment of any of clauses 23-24, wherein cylindrical sheath has a frustoconical shape.

Aspects of the present disclosure have been described with the intent to be illustrative rather than restrictive. Alternative aspects will become apparent to those skilled in the art that do not depart from its scope. A skilled artisan may develop alternative means of implementing the aforementioned improvements without departing from the scope of the present disclosure.

It will be understood that certain features and subcombinations are of utility and may be employed without reference to other features and subcombinations and are contemplated within the scope of the claims. Not all steps listed in the various figures need be carried out in the specific order described.

What is claimed is:

1. A sleeve comprising:

a cylindrical tube having a first opening at a proximal end, and a second opening at a distal end, the distal end being opposite the proximal end, the cylindrical tube further comprising a third opening through the cylindrical tube, the third opening positioned proximate to the second opening;

wherein the third opening is configured to move between a closed configuration and an opened configuration, wherein the cylindrical tube has a first length when the third opening is in the closed configuration, and wherein the cylindrical tube has a second length when the third opening is in the opened configuration;

an insert coupled to the cylindrical tube proximate a perimeter of the third opening, wherein the insert extends across the third opening when the third opening is in the opened configuration;

a releasable fastener coupled proximate to the perimeter of the third opening, wherein the insert includes a cylindrical sheath configured to receive a thumb.

2. The sleeve of claim 1, wherein the cylindrical tube is comprised of a knit fabric or a woven fabric.

3. The sleeve of claim 1, wherein a perimeter edge of the insert is affixed to a third opening perimeter edge.

4. The sleeve of claim 1, wherein the cylindrical sheath includes an aperture at a distal end of the cylindrical sheath.

5. The sleeve of claim 1, wherein the insert is affixed to an interior surface of the cylindrical tube proximate a perimeter of the third opening.

6. The sleeve of claim 1, wherein the insert is integrally formed with the cylindrical tube.

7. The sleeve of claim 1, wherein the insert is exposed through the third opening when the releasable fastener is unfastened.

8. The sleeve of claim 1, wherein the insert is stowed within the sleeve when the releasable fastener is fastened.

9. An extendable sleeve comprising:

a cylindrical tube having a first opening at a proximal end, a second opening at a distal end, the distal end being opposite the proximal end, and a third opening through the cylindrical tube between the distal end and the proximal end defined by at least one perimeter edge;

an insert affixed to the cylindrical tube around a perimeter of the third opening; and a releasable fastener coupled to the cylindrical tube proximate the third opening, wherein the cylindrical tube has a first length when in a retracted state and the cylindrical tube has a second length when in an extended state, wherein the insert is positioned between the at least one perimeter edge when the cylindrical tube is in the extended state, wherein the releasable fastener is unfastened when the cylindrical tube is in the extended state, wherein the releasable fastener is fastened when the cylindrical tube is in the retracted state, and wherein the insert includes a cylindrical sheath configured to receive a thumb.

10. The extendable sleeve of claim 9, wherein the releasable fastener comprises a zipper system.

11. The extendable sleeve of claim 10, wherein the zipper system includes a first zipper tape and a second zipper tape, wherein the first zipper tape is affixed to the cylindrical tube around a first portion of the at least one perimeter edge of the third opening, and wherein the second zipper tape is affixed to the cylindrical tube around a second portion of the at least one perimeter edge of the third opening.

12. The extendable sleeve of claim 11, wherein the zipper system extends around a portion of the cylindrical tube in a direction normal to an axial direction of the cylindrical tube when the extendable sleeve is in the retracted state.

13. The extendable sleeve of claim 10, wherein the zipper system is configured to be positioned proximate a wearer's wrist when the extendable sleeve is in the retracted state in an as-worn configuration.

14. The extendable sleeve of claim 10, wherein the zipper system is spaced a first distance from the distal end of the cylindrical tube.

15. The extendable sleeve of claim 14, wherein the distal end of the cylindrical tube can be pulled in an axial direction of the cylindrical tube to move the extendable sleeve to the extended state after the zipper system has been unfastened.

16. The extendable sleeve of claim 15, wherein the distal end of the cylindrical tube is configured to cover a portion of a wearer's hand when the cylindrical tube is in the extended state in an as-worn configuration.

17. A method of manufacturing a sleeve having an integrated insert, the method comprising:

forming a third opening in a cylindrical tube having a first opening at a proximal end and a second opening at a distal end, the distal end being opposite of the proximal end, wherein the third opening is formed between the distal end and the proximal end, and wherein the third opening has a perimeter;

affixing an insert to the cylindrical tube around the perimeter of the third opening, wherein the insert includes a cylindrical sheath configured to receive a thumb; and affixing a releasable fastener to the cylindrical tube proximate the third opening, wherein the sleeve has a first length when the sleeve is in an extended state, wherein the sleeve has a second length when the sleeve is in a retracted state, and wherein the first length is longer than the second length.

18. The method of manufacturing the sleeve having the integrated insert of claim 17 further comprising affixing the proximal end of the cylindrical tube to a torso portion of an article of apparel.

* * * * *